US006884332B2

(12) United States Patent
Forth et al.

(10) Patent No.: US 6,884,332 B2
(45) Date of Patent: Apr. 26, 2005

(54) METHOD AND APPARATUS FOR TREATING AN AQUEOUS ELECTROPLATING BATH SOLUTION

(75) Inventors: Peter Forth, Kitchener (CA); Art Vibert, Kitchener (CA); Madeline Busch, Kitchener (CA); Sarah Stevenson, Kitchener (CA); Hussain Al-Ekabi, Kitchener (CA)

(73) Assignee: Kuntz Electroplating Inc., Kitchener (CA)

( * ) Notice: Subject to any disclaimer, the term of this patent is extended or adjusted under 35 U.S.C. 154(b) by 186 days.

(21) Appl. No.: 10/292,789

(22) Filed: Nov. 12, 2002

(65) Prior Publication Data

US 2003/0150735 A1 Aug. 14, 2003

(30) Foreign Application Priority Data

Nov. 14, 2001 (CA) ..... 2362244

(51) Int. Cl.[7] ..... C25D 21/12; C25D 17/00

(52) U.S. Cl. ..... 205/81; 204/227; 204/232; 204/237; 204/239; 204/275.1; 205/82; 205/98; 205/99; 205/101; 205/271; 205/291; 205/305; 205/787; 205/787.5

(58) Field of Search ..... 205/81, 82, 98, 205/99, 101, 271, 291, 305, 787, 787.5; 204/227, 232, 237, 239, 275.1

(56) References Cited

U.S. PATENT DOCUMENTS

| | | | |
|---|---|---|---|
| 4,157,942 | A | 6/1979 | Tuznik et al. |
| 4,724,084 | A | 2/1988 | Pahmeier et al. |
| 5,192,418 | A | 3/1993 | Hughes et al. |
| 5,290,455 | A | 3/1994 | Rakszawski |
| 5,330,658 | A | 7/1994 | Grant et al. |
| 5,492,624 | A | 2/1996 | Rozich |
| 5,538,636 | A | 7/1996 | Gnann et al. |
| 5,904,832 | A | 5/1999 | Clifford et al. |
| 6,045,707 | A | 4/2000 | Scrudato et al. |
| 6,083,398 | A | 7/2000 | Pittroff et al. |
| 6,126,838 | A | 10/2000 | Huang et al. |
| 6,143,182 | A | 11/2000 | Huang et al. |
| 6,197,206 | B1 | 3/2001 | Wasinger |
| 6,206,098 | B1 | 3/2001 | Cooper et al. |
| 6,309,532 | B1 | 10/2001 | Tran et al. |
| 6,315,886 | B1 | 11/2001 | Zappi et al. |

FOREIGN PATENT DOCUMENTS

| | | |
|---|---|---|
| JP | 03-106493 | 5/1991 |
| JP | 10-277568 | 10/1998 |

*Primary Examiner*—Robert R. Koehler
(74) *Attorney, Agent, or Firm*—Leydig, Voit & Mayer, Ltd.

(57) ABSTRACT

A method and apparatus for treating an aqueous electroplating bath solution. The method comprises continuously agitating the solution; adjusting the pH of the solution, adjusting the temperature of the solution while adding an amount of hydrogen peroxide sufficient to promote dissolution of the hydrogen peroxide and generation of hydroxyl radicals; and adding an amount of an iron-containing compound so as to increase the rate of dissolution of the hydrogen peroxide to hydroxyl radicals so as to oxidize the organic compounds; whereby the total amount of organic carbon compounds in the solution is reduced. The apparatus comprises a treatment vessel, a pump for transferring a portion of the solution from the vessel to a mixing tank and for transferring a second portion of the solution to a heat exchanger for heating or cooling the second portion of the solution and a pump for transferring hydrogen peroxide to the vessel.

20 Claims, 4 Drawing Sheets

METHOD AND APPARATUS FOR TREATING AN AQUEOUS ELECTROPLATING BATH SOLUTION

FIELD OF INVENTION

This invention relates to a method and apparatus for treating an aqueous electroplating bath solution and, in particular, a method and apparatus for treating and controlling organic constituents within an electroplating bath solution.

BACKGROUND OF THE INVENTION

Electroplating is of great interest in many industries for many industrial purposes. Electroplating processes are used for the plating of metals on automotive parts such as bumpers and wheel rims. Sequential electroplating steps using processes containing different metals in combination with organic additives are required for many exterior and interior applications. Such metallic coatings protect the surface of the substrate from corrosion and provides a reflective, tarnish resistant finish.

Known electrolytic baths consist of an anode and a cathode, an external current source and an electrolyte salt solution within a non-conductive bath container. In use, a substrate to be plated with a metal is placed at the cathode and the metal ions in solution migrate toward the cathode under the impetus of the electrical current flowing between the anode and the cathode. Certain organic compounds are added to the electroplating bath to act as grain refining agents for the metal being plated. Such compounds also affect the brightness of the metal being plated. In nickel plating, particularly where semi-bright nickel solutions are used, an organic compound such as coumarin is often used. Saccharin is an organic compound which is often used in nickel electroplating baths for bright metal surfaces.

The current applied during electroplating is a direct current. Common metals used for plating onto substrates are transition metals such as nickel, zinc, copper and chromium.

Ongoing current feed to the electroplating bath results in a high amount of organic breakdown products in solution (due to the breakdown of the organic compounds added to the bath for obtaining semi-bright and bright finishes). Such breakdown products may alter the structure and physical properties of the plated product. Typically, the amount of organic breakdown products in the bath solution is controlled by regular and frequent use of activated carbon filtration of the bath solution.

In conventional treatment of an electroplating bath solution, activated carbon is added to the bath solution. The activated carbon may be in powder form in order to maximize the surface area available for treatment or the solution may be passed through a filter packed with activated carbon. In batch treatments the solution is removed from the electroplating bath before it is treated. In the case of the addition of powered activated carbon, mixing of the bath solution takes place and the activated carbon is allowed to settle in the bath. The bath solution is pumped from the treatment vessel and filtered. The nickel in solution complexes with the activated carbon which creates hazardous waste leading to disposal concerns. Also, the activated carbon absorbs organic breakdown products and some of the grain refining agents additives in their unreacted state. The powdered activated carbon is dusty and must be handled appropriately and safety devices must be worn by employees to insure their safety.

Electroplating processes create rinse waters which contain low levels of metal impurities. Such solution must be treated before final discharge to the environment. Various methods for treatment of wastewater from electroplating baths are used, including Advanced Oxidation Technologies (AOT). AOT is a process whereby a hydroxyl radical is generated and employed for the oxidation and thus organic compound destruction is of the organic compounds in such as waste water, for the purification of drinking water, odour control, and so on.

Fenton's reaction has been used in the treatment of such wastewater and groundwater. The use of Fenton's reaction is well known, and involves the use of hydrogen peroxide in conjunction with ferrous ions. The hydrogen peroxide is broken down into a hydroxide ion and a hydroxyl free radical. The hydroxyl radical is an oxidizing agent which can be used to oxidize and break apart organic molecules. The reaction is as follows:

$$Fe^{2+}+H_2O_2 \rightarrow Fe^{3+}+OH^{-}+.OH$$

Methods of generating hydroxyl radicals in addition to Fenton's reaction include catalytic ozonation, anodic oxidation, ultraviolet light treatment with hydrogen peroxide, chemical oxidation and titanium dioxide photocatalysis.

It is desirable to be able to reduce disposal of hazardous waste materials (solid or liquid) generated by activated carbon treatment, reduce human exposure to chemical agents and reduce the volume of bath solution needed to be treated to reduce the amount of expensive organic grain refining agents removed from the bath during treatment. It is also desirable to reduce and control the amount of organic breakdown products in the bath solution to increase the effectiveness and lifespan of the electroplating bath solution and ensure consistent physical properties and appearance of the metal being plated.

The disadvantages of the prior art may be overcome by a method and apparatus for treating an electroplating bath solution where the bath solution comprises organic compounds and a metal intended to be plated onto a substrate in the bath solution. The method in its broad aspect provides introducing an iron-containing compound into an electroplating bath solution, adjusting the pH of the bath solution and the temperature of the vessel to promote dissolution of hydrogen peroxide and generation of hydroxyl radicals, whereby the total amount of organic compounds in the bath solution is reduced.

The apparatus in its broad aspect comprises a treatment vessel for receiving the bath solution, a pump in communication with the treatment vessel for transferring a portion of the bath solution into a mixing tank for mixing and another portion into a heat exchanger for heating or cooling; another pump transfers the hydrogen peroxide to the treatment vessel whereby the bath solution is treated with iron-containing compounds and the hydrogen peroxide.

The inventors herein have unexpectedly discovered a method of treating an electroplating bath solution which comprises adjusting the pH in the range of 3.5 to 4.2 and adjusting the temperature of the bath to be in the range of 43° C. to 83° C. while adding an amount of hydrogen peroxide to the bath sufficient to promote dissolution of the hydrogen peroxide and generation of hydroxyl radicals.

In a preferred embodiment, the source of iron is ferrous sulphate and the pH is in the range of 3.7 to 4.0. The total organic carbon (TOC) is preferably reduced to a value approximately half of its original concentration. The water soluble nickel salt used for a bath for electroplating nickel is preferably selected from the group consisting of nickel sulphate, nickel chloride and nickel carbonate and mixtures thereof. Other baths having other metallic salts such as copper and zinc may also be treated in keeping with the present invention.

The method of the invention provides a number of advantages including: reducing the amount of organic breakdown products present in the electroplating bath which increases the effectiveness and lifespan of the bath, reducing downtime of the bath for maintenance, reduction of solid waste generation and handling, reduction of human exposure to potentially hazardous materials, and providing a method effective for treating less solution than the prior art thereby reducing the amount of expensive organic refining agents removed from the bath resulting in the addition of a lower amount of such refining agents for replenishment of the bath.

SUMMARY OF THE INVENTION

To that end, therefore, the present invention provides a method of treating an aqueous electroplating bath solution where the aqueous bath solution comprises organic compounds and a metal intended to be plated onto a substrate. The method comprises the steps of (a) continuously agitating the aqueous bath solution; (b) adjusting the pH of the aqueous bath solution to be in the range of 3.5 to 4.2; (c) adjusting the temperature of the bath solution to be in the range of 43° C. to 83° C. (preferably 43° C. to 69° C.) while adding an amount of hydrogen peroxide to the bath solution sufficient to promote dissolution of the hydrogen peroxide and generation of hydroxyl radicals; and (d) adding an amount of an iron-containing compound into the bath solution so as to increase the rate of dissolution of the hydrogen peroxide to hydroxyl radicals so as to oxidize said organic compounds; (e) whereby the total amount of organic carbon compounds in the bath solution is reduced.

The bath solution is treated in a treatment vessel. The iron-containing compound is a ferrous and/or ferric compound. The iron-containing compound is added to the aqueous bath solution in an amount to bring the amount of ferrous ion therein to 10 ppm to 100 ppm.

The metal intended to be plated onto a substrate is present in the aqueous bath solution as a metallic salt of the metal in solution and often a nickel salt chosen from the group consisting of nickel sulphate, nickel chloride, nickel carbonate and mixtures thereof.

The total amount of organic carbon present in the aqueous bath solution is reduced to about half of its initial concentration by the method of the invention and, in particular the total amount of organic carbon in the aqueous electroplating bath is reduced from a range of 1.5 g/L to 2.5 g/L to less than 0.7 g/L.

The pH of the aqueous bath solution is adjusted and maintained in the range of 3.7 to 4.0 and the iron-containing compound is chosen from the group consisting of ferrous sulphate, ferrous chloride, ferric sulphate and mixtures thereof.

The iron-containing compound is added to the aqueous bath solution in an amount of 10 ppm to 45 ppm of iron and the hydrogen peroxide is a hydrogen peroxide solution which is 50% by volume and which is added in an amount of 10 ml/L to 40 ml/L and preferably 25 ml/L.

The bath solution may be agitated by an eductor mixer.

The apparatus of the invention for reducing the total amount of organic carbon in an aqueous electroplating bath solution comprises a treatment vessel for receiving the bath solution for treatment, a pump in communication with the treatment vessel for transferring a first portion of the bath solution from the treatment vessel to a mixing tank such as an open tank and for transferring a second portion of the bath solution to a heat exchanger located remote from the treatment vessel for heating or cooling the second portion of the bath solution. A pump is in communication with the treatment vessel for transferring hydrogen peroxide to the treatment vessel, whereby the bath solution may be treated in the treatment vessel with an iron-containing compound and hydrogen peroxide to reduce the total amount of organic carbon in the bath solution.

BRIEF DESCRIPTION OF THE DRAWINGS

Preferred embodiments of the present invention will now be described, by way of example only, with reference to the attached Figures, wherein.

DETAILED DESCRIPTION OF THE PREFERRED EMBODIMENT

Figure 1:
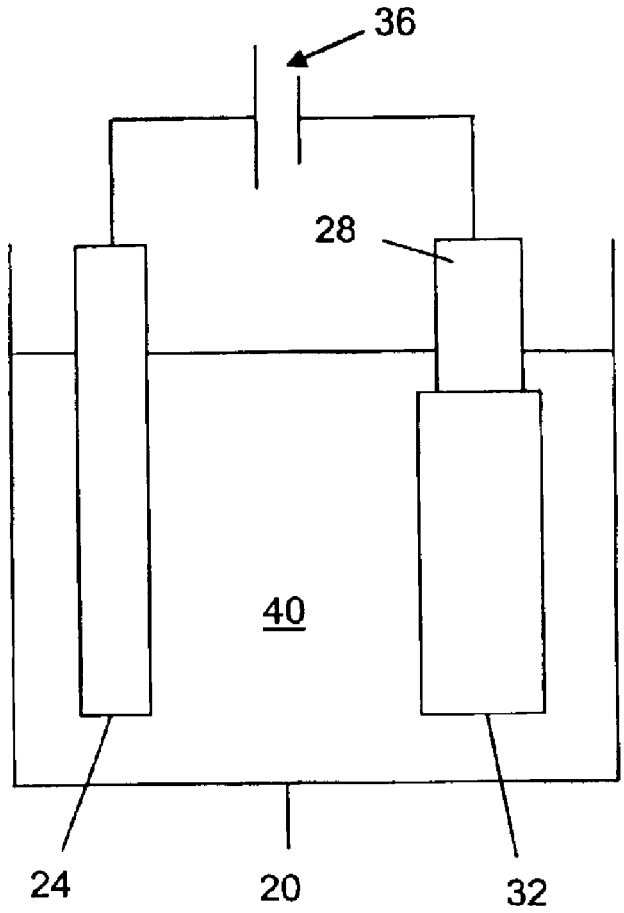
Fig. 1 (PRIOR ART)
FIG. 1 is a schematic view of a prior art electroplating bath.

An electroplating bath is indicated generally at 20 in FIG. 1. The electroplating bath 20 includes an anode 24 and a cathode 28. A workpiece or substrate 32 is disposed on the cathode 28. The anode 24 and the cathode 28 are connected to a suitable source 36 of dc current. An aqueous solution 40 is contained within the bath 20.

In one embodiment of the present invention, nickel is being plated onto the workpiece 32 in the electroplating bath 20. The aqueous electrolytic solution 40 contains a soluble nickel salt such as nickel sulphate, nickel chloride, nickel carbonate or mixtures thereof. When a suitable supply of current is applied between the anode 24 and the cathode 28, the nickel ions in solution migrate toward the cathode 28 and are reduced at the cathode 28 and plated onto the workpiece 32.

Figure 2:
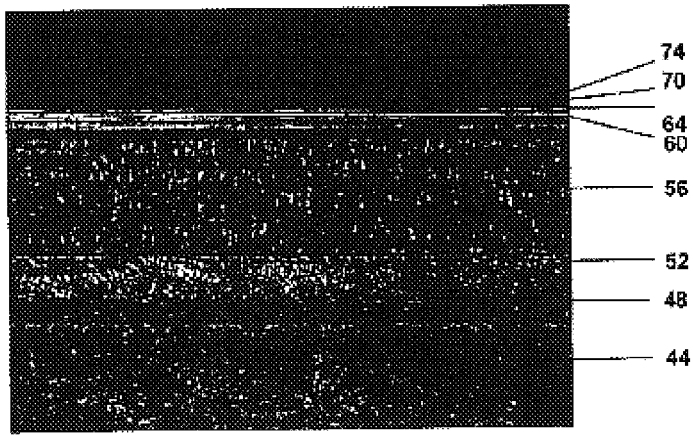
FIG. 2 is a cross-sectional view of a multi-layer plated substrate.

Many plating processes require multi-layering of different metals. FIG. 2 shows an aluminum substrate 44 that has been layered with a pre-plating compound 48 having a thickness of at least 5 $\mu$m, a copper layer 52 of at least 15 $\mu$m, a semi-bright nickel layer 56 of at least 30 $\mu$m, a high sulphur containing nickel layer 60 of less that 5 $\mu$m, a bright nickel layer 64 of about 10 $\mu$m, a thin layer of nickel 70, and a chromium layer 74 of at least 0.25 $\mu$m.

Semi-bright nickel plating baths as well as most other nickel plating baths contain wetting agents or surfactants, which are normally long straight chained organic compounds. For example, in semi-bright nickel plating coumarin, $C_9H_6O_2$, is added to the bath 20. The plating from a semi-bright plating bath yields a semi-dull high leveling and ductile deposit. Saccharin may be added to an electroplating bath 20 to ensure a bright finish when plating bright nickel onto the substrate 32.

Organic breakdown products resulting from breakdown of the virgin organic bath additives for the plating process remain in solution in the electroplating bath 20. Breakdown products of additives such as coumarin (in the case of semi-bright nickel plating methods) and saccharin (in bright nickel plating methods) remain in the electroplating bath 20 after the substrate 32 has been plated. After repeated plating processes, a build-up of such organic breakdown products in the electroplating bath 20 modifies the grain structure of the metal being deposited onto the substrate and as a result alters its appearance and the physical properties of the metal. It is this build-up of organic breakdown products and bath additives unreacted which is referred to as Total Organic Carbon (TOC) in electroplating bath processes, and which the present invention mitigates by reducing the TOC to an acceptable level.

Figure 3:
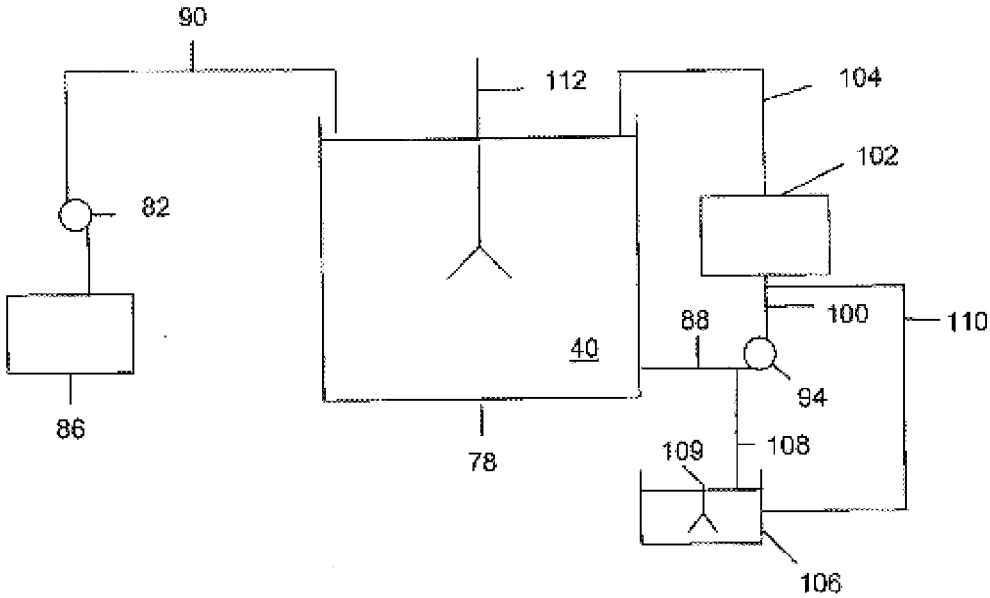
FIG. 3 is a schematic view of a storage tank containing solution from an electroplating bath, such solution is to be treated with the method of the invention.

In the present invention, the electroplating process being carried out in the bath 20 stopped and the nickel bath solution to be treated 40 is removed from the electroplating bath 20 and added to the treatment vessel 78 shown in FIG. 3. Multiple bath solutions may be treated in treatment vessel 78 provided the same metal is being plated in such baths. The TOC, pH and iron content of the solution are analyzed. The pH and temperature of the solution is adjusted to the operating range. Hydrogen peroxide is added to the treatment vessel 78 by using a pump 82 to transport the hydrogen peroxide from storage tank 86 through conduit 90 and into the treatment vessel 78. Pump 94 is used to assist in the mixing of the bath solution 40 through conduit 88. A portion of the bath solution 40 is pumped from vessel 78 by pump 94 through conduit path 100 to heat exchanger 102 for heating and cooling the solution and then returned to the vessel 78 through conduit 104. At the same time, a portion of the bath solution 40 is dispensed into mixing tank 106 through conduit 110. A mechanical mixer 109 mixes the bath solution 40 in the mixing tank 106. The mixing tank 106 is an open tank. Ferrous iron is added to the mixing tank 106 to increase the iron content of the nickel bath to a previously calculated value. Ferric iron may also be used but is less efficient than ferrous iron. The bath solution 40 in the mixing tank 106 is transported back into the treatment vessel 78 through a conduit 108. The bath solution 40 exiting the heat exchanger 102 through conduit 104 draws the bath solution 40 from conduit 110 into conduit 104. For treatment of smaller volumes, a mixer 112 may be used rather than an eductor system utilizing a mixing tank 106.

The pH is adjusted during the treatment process to ensure that the ferrous ion stays dissociated and in solution and also to make the hydrogen peroxide more stable so that it does not degrade as rapidly. After the treatment has been completed, the pH is adjusted to 4.6 to assist in precipitating out residual ferrous ion prior to the plating bath being returned back to service condition. The solution is continuously agitated throughout the treatment process to ensure there are no localized reactions.

Commercially available hydrogen peroxide, 30% to 70% by volume is used. When 50% by volume hydrogen peroxide is used, such is added in the range of 10 mL/L to 40 mL/L and preferably 25 mL/L. Some iron is in solution through the acidic bath effects on the workpieces being plated. The total iron content is determined and a ferrous iron-containing compound is added so that the amount of total iron is in the range of 10 ppm to 100 ppm and more preferably 10 ppm to 45 ppm. The ferrous compound is chosen from ferrous sulphate or ferrous chloride and is preferably ferrous sulphate. The bath solution 40 may be aerated by adding oxygen. Due to the acidity of the bath solution 40, ferric iron may be added to the bath solution 40 to increase the iron content of the bath solution 40.

The pH of the bath solution 40 is monitored by means of a pH meter and the temperature of the treatment vessel 78 is monitored continuously. Hydrogen peroxide and residual TOC are monitored periodically.

In one embodiment of the present invention, the pH of the bath solution 40 has been determined and adjusted to a range of 3.5 to 4.2. The temperature of the treatment vessel 78 is in a range of 110° F. (43.3° C.) to 180° F. (82.2° C.) and more preferably 110° F. (43.3° C.) to 155° F. (68.3° C.). The temperature of the treatment vessel 78 is adjusted by means of the heat exchanger 102. An increase in temperature increases the rate of the reaction. The solution is continuously agitated throughout the treatment process to ensure there are no localized reactions.

In a further embodiment of the present invention, the pH is in the range of 3.7–4.0. The pH may be lowered by adding sulphuric acid or raised by adding a base such as nickel carbonate when nickel ions are in the bath solution 40. The concentration of total iron is preferably less than 100 ppm.

As the pH is raised, iron will start to precipitate out of solution and as this solution is normally filtered, this precipitate will be removed by the filtration process.

The use of hydrogen peroxide and a ferrous ion-containing compound is known as Fenton's reaction. It has been discovered that a hybrid Fenton reaction, which is metal catalyzed by the predominate ion within the plating bath, and which employs the use of iron (as ferrous salts) is extremely effective to remove organic carbon from nickel plating solutions. The ferrous salts in association with the metal plating bath ion, react with hydrogen peroxide to generate hydroxyl radicals, which are powerful oxidizing agents. A metal catalyzed hybrid Fenton's reaction yields an oxidized ion of the predominate metallic ion in solution, ferric ion and hydroxyl radical according to the following equation (Me represents the plating metal ions in solution).

$$Fe^{2+}+H_2O_2+Me \rightarrow Fe^{3+}+OH^-+.OH$$

A perhydroxyl radical is also produced as follows:

$$Fe^{3+}+H_2O_2+Me \rightarrow Fe^{2+}+.OOH+H^+$$

The chemical reactions of the hydroxyl radical in aqueous solutions are generally of four types:

1. Addition: $.OH+CnHn \rightarrow .(OH)CnHn$ Where the hydroxyl radical adds to an unsaturated compound
2. Hydrogen Abstraction: $.OH+CH_3OH \rightarrow .CH_2OH+H_2O$ Formulation of organic free radical and water
3. Electron Transfer: $Fe^{2+}$ converts to $Fe^{3+}$ and metal catalyst ion converts to a higher valence state
4. Radical Interactions: $.OH+.OH \rightarrow H_2O_2$ As with most oxidants, the hydroxyl radical is indiscriminate in nature and will ultimately oxidize all organic constituents within the plating solution. The virgin organic brightener and surfactant along with their breakdown products, as a result of electrolysis, will as a result of the interaction of the hydroxyl radical be oxidized through various intermediates, and if given enough reaction time will ultimately be converted to carbon dioxide.

The hydroxyl radical attacks the double bonds of the organic breakdown products in solution, thereby reducing the organic by-product into smaller organic molecules such as organic acids which are not problematic to the electroplating occurring in the electroplating bath 20. Carbon dioxide gas or carbonate (dispelled in solution) may be dispelled as the waste product. The reaction is as follows:

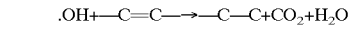

$$.OH + —C=C— \rightarrow —C—C + CO_2 + H_2O$$

Simple organic structures like surfactants can break down readily to form carbon dioxide. More complicated organic structures, similar to coumarin, may only have a portion of their structure break down to this level, while the remainder stays in solution as a short chain hydrocarbon. The degree of breakdown is controlled by the level of free radical in solution.

Individual organic compounds can be measured within the treatment process using analytical methods; however, due to oxidation reactions these compounds are difficult to quantify and track. An alternative method to monitoring the process is by measuring the TOC. The TOC may be monitored by an analyzer such as Dohrmann Phoenix Model 8000 TOC Analyzer or the like. The volume of hydrogen peroxide added into the treatment vessel 78 is selected as a function of TOC of the bath solution 40 and the degree of TOC reduction desired.

The metal salt in solution in the electroplating bath to be treated is preferably nickel used for semi-bright plating. Bright nickel plating baths may be treated with the method of the present invention. The organic plating promoters and organic breakdown products in the electroplating bath for bright nickel plating differ from those in the bath in respect of semi-bright plating. For such solutions, nickel carbonate is added to increase pH of the bath solution. Electroplating baths for plating zinc and copper may also be treated according to the method of the present invention.

The following examples are included to further illustrate the invention herein described and claimed. The examples are not intended as limitations of the present invention.

EXAMPLE 1

A test within a 550 litre 'pilot' unit was conducted.

Initial observations indicated that the method of the invention removed the virgin organic constituents as well as the conventional hydrogen peroxide/activated carbon system. However, the difference lay in the ability of the method of the invention to remove substantially more of the unwanted and detrimental organic breakdown products. Based on the TOC levels of semi-bright plating solutions which were about to be treated, due to ductility and internal stress concerns, it was determined that reduction of TOC was economical to TOC levels of 0.3–0.5 g/l. Concentrations of organic constituents during the treatment period were monitored by conventional testing methods such as UV Spectrophotometer and HPLC. The hydrogen peroxide concentrations were monitored and maintained using a simple wet titration method. Hull cell testing was used to evaluate completed process solution. Conventional electroplating tests were performed on the treated bath solution and on nickel film plated from the treated solution to verify that the treated bath met acceptable electroplating standards. The nickel bath was analyzed for the required salt components and for known impurities. Hull cell tests were used to plate a nickel film required for tensile strength, ductility and sulphur testing. Test results showed that the bath treated with the method of the invention met acceptable performance levels.

As a comparison the same bath solution was treated using the conventional activated carbon treatment method. The conventional activated carbon treatment is as follows:

1) Addition of hydrogen peroxide (0.1 to 0.15% by volume of hydrogen peroxide) to solution requiring treating. Let temperature increase to 140 to 160 degrees Fahrenheit for 2 hours.
2) Addition of activated carbon to solution (5 to 7 grams of activated carbon/litre of solution) let mix 2 hours.
3) Let solution settle and cool minimal 8 hours before filtration of solution.

A comparison between the conventional treatment method and the method of the invention is as follows:

| | Conventional $H_2O_2$/ Activated Carbon Treatment | Invention Method |
|---|---|---|
| TOC Reduction | 29% | 66% |
| Organic Brightener Reduction | 100% | 100% |
| By-product Reduction | 21% | 38 to 50% |

The equal effectiveness indicated by the two processes is due to the fact that "organic brightener" is representative of only the main feed brightener known as coumarin. So the product known as coumarin is not present afterwards, but breakdown products of it still are and these are measured by the TOC method. There is a known by-product of coumarin that is analyzed for on a regular basis, so the reduction value is a measure of this product only.

Figure 4:
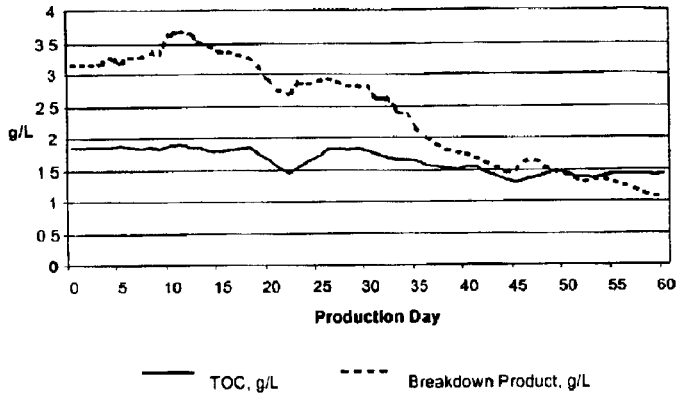
FIG. 4 is a chart of the levels of total organic carbon and organic breakdown products in an electroplating bath over a period of several months when the bath is treated weekly in accordance with the method of the invention.

Full scale testing commenced to evaluate this observation and also to ensure no detrimental side effects. This trial continued for 12 weeks in a segregated 'working' semi-bright nickel plating solution environment. During the trial period approximately 20% to 25% of the bath contents were treated weekly. All standard and routine testing was completed in addition to monitoring the reduction of organics and monitoring TOC levels (FIG. 4).

TOC levels gradually were lowered to a level around 1.5 g/l and maintained at this level. Hull cells were done on the treated SBN (semi-bright nickel) solution and the resulting foils tested for ductility, sulphur content and tensile strength. These parameters were within acceptable limits (these limits are provided by the supplier and manufacturer of the brightener package used within the plating processes). The results indicated that the method of the invention continued to be effective in maintaining and controlling all physical deposit characteristics in the plating process which required utilizes a high amount of inert auxiliary anode use.

EXAMPLES 2A AND 2B

Lab scale tests were conducted to demonstrate the effect of ferrous ions on the rate and efficiency of TOC reduction. A virgin semi-bright nickel bath containing the normal nickel salts and organic additives was prepared. Melilotic acid (this is the known breakdown product monitored) and phthalic acid (organic compounds) were added to raise the TOC to 1.5 g/L and the temperature was 149° F. (65° C.)±2° F. (1° C.).

Nickel carbonate was added to raise the pH to 3.0. 20 mL/L of 50% (by volume) hydrogen peroxide was added at time=0. The bath was slightly aerated. In the first test 2A no iron was added. In the comparative test trial no. 2B, 45 ppm iron was added as ferrous sulphate. The first test showed a very slow and inefficient reaction compared with the results of the bath with 45 ppm iron.

The test results are shown below. P104 is a mixture of known organic additives.

EXAMPLE 2A (No Iron)

| Time from Test Start min | Temp F. | pH | TOC g/L | Organic Additive (P104) g/L | Breakdown Product g/L | 50% $H_2O_2$ Present mL/L |
|---|---|---|---|---|---|---|
| 0 | 150 | 2.98 | 1.43 | 1.12 | 8.97 | 0 |
| 25 | 149 | 2.96 | 1.43 | 1.10 | 8.87 | 22.1 |
| 60 | 149 | 2.95 | 1.42 | 1.06 | 8.38 | 21.9 |
| 90 | 149 | 2.99 | 1.39 | 1.07 | 8.13 | 22.3 |
| 120 | 148 | 3.08 | 1.41 | 1.10 | 7.49 | 22.1 |
| 180 | 147 | 2.97 | 1.34 | 1.15 | 5.71 | 21.6 |
| after 26 hr | 151 | 3.01 | 0.79 | 0.25 | 1.32 | 13.6 |

EXAMPLE 2B (45 ppm fe)

| Time from Test Start min | Temp F. | pH | TOC g/L | Organic Additive (P104) g/L | Breakdown Product g/L | 50% $H_2O_2$ Present mL/L |
|---|---|---|---|---|---|---|
| 0 | 150 | 3.01 | 1.43 | 1.12 | 8.97 | 0 |
| 20 | 149 | 2.98 | 0.92 | 0.51 | 3.56 | 16.7 |
| 60 | 150 | 2.89 | 0.81 | 0.34 | 2.35 | 12.8 |
| 90 | 149 | 3.02 | 0.75 | 0.27 | 1.86 | 11.6 |
| 120 | 148 | 2.97 | 0.73 | 0.28 | 1.66 | 11.4 |
| 180 | | | 0.69 | 0.28 | 0.96 | 9.2 |
| after 17 hr | 149 | 2.75 | 0.20 | 0.26 | 0.33 | 0.2 |

EXAMPLES 3, 4 AND 5

Figure 5:
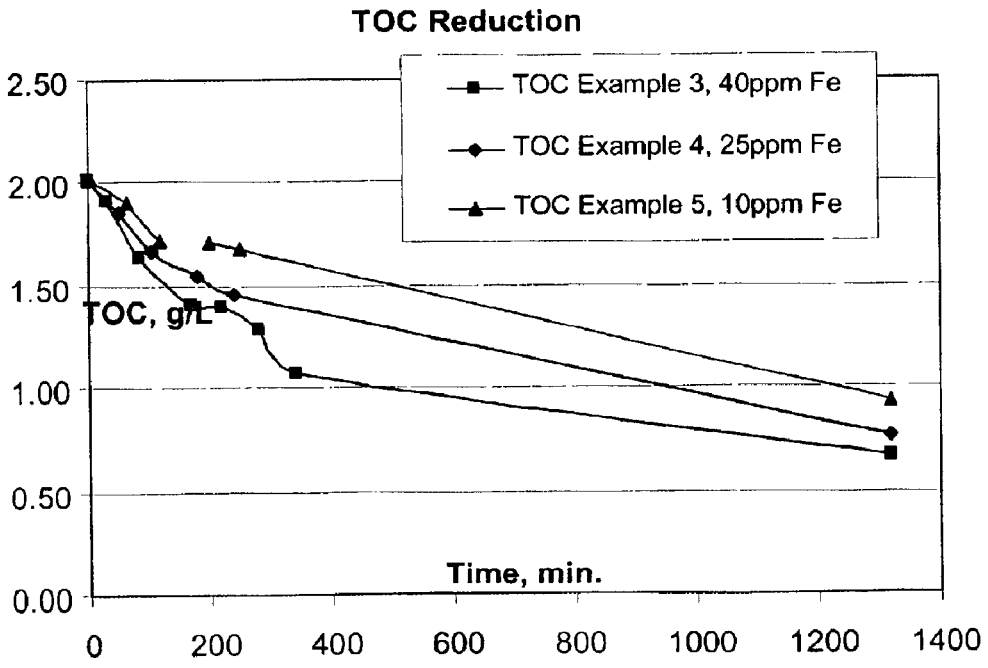
FIG. 5 is a chart of the levels of total organic carbon in an electroplating bath during the treatment time when the bath is treated in accordance with the method of the invention.

Lab tests were performed using nickel solution from a working plating bath to determine the level of ferrous ions required to produce a satisfactory reaction rate. The data showed a decrease in the organic breakdown products and TOC at all iron levels but a faster reaction rate at the higher iron concentrations. FIG. 5 is a chart of the TOC levels in the bath solution during examples 3, 4 and 5.

EXAMPLE 3

(40 ppm fe)

| Time from Test Start min | Temp (F.) | TOC g/L | Organic Additive (P104) g/L | Breakdown Product g/L | 50% $H_2O_2$ Present mL/L |
|---|---|---|---|---|---|
| 0 | 140 | 2.01 | 1.08 | 3.40 | 25.0 |
| 30 | 146 | 1.91 | 0.53 | 2.74 | 22.0 |
| 85 | 150 | 1.64 | 0.23 | 1.77 | 17.0 |
| 170 | 150 | 1.41 | 0.20 | 1.17 | 12.0 |
| 220 | 151 | 1.40 | 0.19 | 1.15 | 9.5 |
| 280 | 150 | 1.29 | 0.20 | 1.01 | 7.5 |
| 340 | 150 | 1.07 | 0.20 | 0.98 | 6.0 |
| 1320 | 150 | 0.66 | 0.12 | 0.333 | 0.1 |

EXAMPLE 4

(25 ppm fe)

| Time from Test Start min | Temp (F.) | TOC g/L | Organic Additive (P104) g/L | Breakdown Product g/L | 50% $H_2O_2$ Present mL/L |
|---|---|---|---|---|---|
| 0 | 140 | 2.01 | 1.08 | 3.40 | 25.0 |
| 50 | 151 | 1.86 | 0.43 | 2.46 | 22.5 |
| 105 | 150 | 1.67 | 0.21 | 1.71 | 19.5 |
| 180 | 150 | 1.55 | 0.17 | 1.32 | 15.0 |
| 240 | 149 | 1.46 | 0.15 | 0.98 | 13.6 |
| 1320 | 150 | 0.76 | 0.11 | 0.403 | 0.1 |

EXAMPLE 5

(10 ppm fe)

| Time from Test Start min | Temp (F.) | TOC g/L | Organic Additive (P104) g/L | Breakdown Product g/L | 50% $H_2O_2$ Present mL/L |
|---|---|---|---|---|---|
| 0 | 140 | 2.01 | 1.08 | 3.40 | 25.0 |
| 65 | 153 | 1.90 | 0.48 | 2.51 | 23.0 |
| 120 | 150 | 1.72 | 0.28 | 1.94 | 21.0 |
| 200 | 151 | 1.71 | 0.17 | 1.55 | 17.5 |
| 250 | 150 | 1.68 | 0.14 | 1.36 | 17.0 |
| 1320 | 150 | 0.93 | 0.09 | 0.414 | 0.1 |

EXAMPLES 6, 7 AND 8

Figure 6:
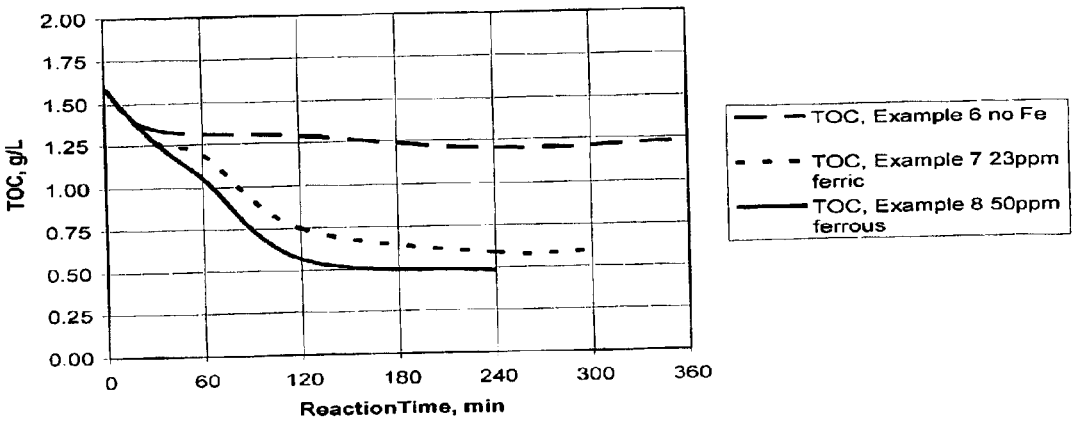
FIG. 6 is a chart of the levels of total organic carbon in an electroplating bath during the treatment time when the bath is treated in accordance with the method of the invention comparing the use of ferrous and ferric iron containing compounds.

Lab tests were performed using nickel solution from a working plating bath, iron was added in ferrous and ferric form, the temperature was 66° C. and 40 ml/L of 50% (by volume) hydrogen peroxide was added at time=0. In example 6 no iron was added. In example 7, 45 ppm of iron as ferric sulphate was added and, in example 8, 45 ppm of iron as ferrous sulfate was added. The data showed a decrease in the organic breakdown products and TOC, particularly when ferrous iron was added as the iron compound. FIG. 6 is a chart of the TOC levels in the bath during examples 6, 7 and 8.

EXAMPLE 6

(no iron added)

| Time from Test Start min | Temp (F.) | pH | TOC g/L | Organic Additive (P104) g/L | Breakdown Product g/L | 50% $H_2O_2$ Present mL/L |
|---|---|---|---|---|---|---|
| 0 | 142 | 3.87 | 1.59 | 1.04 | 3.47 | 40 |
| 30 | 147 | 3.48 | 1.34 | 0.79 | 3.56 | 34.8 |
| 2 hr | 148 | 3.30 | 1.29 | 0.19 | 1.31 | 21.8 |
| 4 hr | 148 | 3.40 | 1.20 | 0.08 | 0.84 | 2.6 |
| 6 hr | 150 | 3.30 | 1.23 | 0.06 | 0.65 | 2.2 |

EXAMPLE 7

(+45 ppm ferric iron)

| Time from Test Start min | Temp (F.) | pH | TOC g/L | Organic Additive (P104) g/L | Breakdown Product g/L | 50% $H_2O_2$ Present mL/L |
|---|---|---|---|---|---|---|
| 0 | 147 | 3.87 | 1.59 | 1.04 | 3.47 | 40 |
| 30 | 151 | 3.19 | 1.27 | 0.19 | 1.86 | 26.7 |
| 60 | 152 | | 1.19 | 0.14 | 1.34 | 0.0 |
| 2 hr | 149 | 3.40 | 0.75 | 0.13 | 0.90 | 9.5 |
| 4 hr | 150 | 3.93 | 0.59 | 0.12 | 0.45 | 0.3 |

EXAMPLE 8

(+45 ppm ferrous iron)

| Time from Test Start min | Temp (F.) | pH | TOC g/L | Organic Additive (P104) g/L | Breakdown Product g/L | 50% $H_2O_2$ Present mL/L |
|---|---|---|---|---|---|---|
| 0 | 145 | 3.87 | 1.59 | 1.04 | 3.47 | 40 |
| 30 | 151 | 3.26 | 1.27 | 0.24 | 1.85 | 24 |
| 60 | 149 | | 1.05 | 0.21 | 1.22 | 0.0 |
| 2 hr | 150 | 3.77 | 0.57 | 0.14 | 0.47 | 1.4 |
| 4 hr | 150 | 3.95 | 0.48 | 0.08 | 0.29 | 0.3 |

As is evident from above, the invention is effective over a wide range of operating conditions and iron compound additives.

It will be understood that modifications can be made in the embodiments in the invention herein without departing from the scope and purview of the invention as described in the claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

We claim:

1. A method of treating an aqueous electroplating bath solution where said aqueous bath solution comprises organic compounds and a metal intended to be plated onto a substrate, said method comprising the steps of:

(a) continuously agitating said aqueous bath solution;

(b) adjusting the pH of the aqueous bath solution to be in the range of 3.5 to 4.2;

(c) adjusting the temperature of the bath solution to be in the range of 43° C. to 83° C. while adding an amount of hydrogen peroxide to said bath sufficient to promote dissolution of said hydrogen peroxide and generation of hydroxyl radicals; and (d) adding an amount of an iron-containing compound into said bath solution so as to increase the rate of dissolution of said hydrogen peroxide to hydroxyl radicals so as to oxidize said organic compounds;

(e) whereby the total amount of organic carbon compounds in said bath solution is reduced.

2. The method of claim 1 wherein said bath solution is transferred to a treatment vessel.

3. The method of claim 1 wherein said iron-containing compound is a ferrous compound.

4. The method of claim 1 wherein said iron-containing compound is added to said aqueous bath solution in an amount to bring the amount of ferrous ion therein to 10 ppm to 100 ppm.

5. The method of claim 1 wherein said iron-containing compound is a ferric compound.

6. The method of claim 1 wherein said metal intended to be plated onto a substrate is present in said aqueous bath solution as a metallic salt of said metal in solution.

7. The method of claim 6, wherein said metallic salt is a nickel salt.

8. The method of claim 7, wherein said nickel salt is chosen from the group consisting of nickel sulphate, nickel chloride, nickel carbonate and mixtures thereof.

9. The method of claim 1, wherein the total amount of organic carbon present in said aqueous bath solution is reduced to about half of its initial concentration.

10. The method of claim 1, wherein the total amount of organic carbon in said aqueous bath solution is reduced from a range of 1.5 g/L to 2.5 g/L to less than 0.7 g/L.

11. The method of claim 1, wherein the pH of said aqueous bath solution is adjusted and maintained in the range of 3.7 to 4.0.

12. The method of claim 1, wherein said iron-containing compound is chosen from the group consisting of ferrous sulphate, ferrous chloride, ferric sulphate and mixtures thereof.

13. The method of claim 12, wherein said iron-containing compound is added to said aqueous bath solution in an amount of 10 ppm to 45 ppm of iron.

14. The method of claim 1, wherein said hydrogen peroxide is a hydrogen peroxide solution which is 50% by volume.

15. The method of claim 14, wherein said hydrogen peroxide solution is added in an amount of 10 ml/L to 40 ml/L.

16. The method of claim 14 wherein said hydrogen peroxide solution is added in an amount of 25 ml/L.

17. The method of claim 1 wherein said temperature is in the range of 43° C. to 69° C.

18. The method of claim 1 wherein said bath is agitated by using an eductor mixer.

19. An apparatus for reducing the total amount of organic carbon in an aqueous electroplating bath solution comprising, in combination:

a treatment vessel for receiving said bath solution for treatment;

a pump in communication with said treatment vessel for transferring a first portion of said bath solution from said treatment vessel to a mixing tank for mixing and transferring a second portion of said bath solution to a heat exchanger located remote from said treatment vessel for heating or cooling said second portion of said bath solution; and a pump, in communication with said treatment vessel for transferring hydrogen peroxide to said treatment vessel, whereby the bath solution may be treated in said treatment vessel with an iron-containing compound and hydrogen peroxide to reduce the total amount of organic carbon in said bath solution.

20. The apparatus of claim 19 wherein said mixing tank is an open tank.

* * * * *